US010487827B2

(12) United States Patent
Carey et al.

(10) Patent No.: US 10,487,827 B2
(45) Date of Patent: Nov. 26, 2019

(54) HIGH PRESSURE PAINT PUMP

(71) Applicant: TriTech Industries, Inc., Union, NJ (US)

(72) Inventors: Danuta H. Carey, Stockholm, NJ (US); Christopher M. Walsh, Florham Park, NJ (US)

(73) Assignee: TriTecch Industries, Inc., Union, NJ (US)

( * ) Notice: Subject to any disclaimer, the term of this patent is extended or adjusted under 35 U.S.C. 154(b) by 0 days.

(21) Appl. No.: 16/287,032

(22) Filed: Feb. 27, 2019

(65) Prior Publication Data

US 2019/0203707 A1 Jul. 4, 2019

Related U.S. Application Data

(63) Continuation of application No. 14/482,223, filed on Sep. 10, 2014, now Pat. No. 10,253,771.

(51) Int. Cl.

| | |
|---|---|
| ***F04B 53/22*** | (2006.01) |
| ***F04B 53/14*** | (2006.01) |
| ***F04B 53/10*** | (2006.01) |
| ***B05B 9/04*** | (2006.01) |
| ***F04B 5/02*** | (2006.01) |
| ***F04B 15/00*** | (2006.01) |
| ***F04B 37/12*** | (2006.01) |
| ***F04B 53/12*** | (2006.01) |

(52) U.S. Cl.

CPC ..... *F04B 53/22* (2013.01); *B05B 9/0413* (2013.01); *F04B 5/02* (2013.01); *F04B 15/00* (2013.01); *F04B 37/12* (2013.01); *F04B 53/1007* (2013.01); *F04B 53/126* (2013.01); *F04B 53/143* (2013.01)

(58) Field of Classification Search

CPC .. F04B 5/02; F04B 15/00; F04B 37/12; F04B 53/1007; F04B 53/126; F04B 53/143; F04B 53/22; B05B 9/0413

See application file for complete search history.

(56) References Cited

U.S. PATENT DOCUMENTS

| | | | | |
|---|---|---|---|---|
| 3,069,178 | A | 12/1962 | Rosen | |
| 3,413,929 | A * | 12/1968 | Cook | F04B 1/0408 417/273 |
| 4,086,936 | A | 5/1978 | Vork | |
| 4,768,929 | A | 9/1988 | Geberth, Jr. | |
| 4,768,932 | A | 9/1988 | Geberth, Jr. | |
| 5,211,611 | A | 5/1993 | Lammers | |
| 5,228,842 | A | 7/1993 | Guebeli et al. | |
| 5,348,454 | A | 9/1994 | Murphy | |
| 5,435,697 | A | 7/1995 | Guebeli | |

(Continued)

*Primary Examiner* — Charles G Freay

(74) *Attorney, Agent, or Firm* — Bucknam and Archer

(57) ABSTRACT

There is provided an airless paint spray pump wherein the pump is a double acting piston pump having an inlet communicating with a source of paint, a motor for driving the pump, a pressure controller for controlling the pressure of the pressurized paint delivered by the pump, and a filter for filtering the paint delivered by the pump. The pump includes features which increase the accessibility of the components thereof, prevent the incorrect installation of the seal packings in the pump cylinder, and allow the assembly of the piston in the pump cylinder properly aligned with the cylinder so as not to damage the seal packings therein.

2 Claims, 8 Drawing Sheets

(56) References Cited

U.S. PATENT DOCUMENTS

| | | | | |
|---|---|---|---|---|
| 5,456,583 | A | 10/1995 | Handzel | |
| 5,671,656 | A | 9/1997 | Cyphers et al. | |
| 6,435,846 | B1 | 8/2002 | Cooper et al. | |
| 6,558,141 | B2 | 5/2003 | Vonalt | |
| 7,444,923 | B2 | 11/2008 | Horning | |
| 10,253,771 | B2 * | 4/2019 | Carey | F04B 53/22 |
| 2013/0034060 | A1 | 12/2013 | Shreve et al. | |
| 2013/0034160 | A1 | 12/2013 | Ma et al. | |
| 2013/0340609 | A1 | 12/2013 | Shreve et al. | |

* cited by examiner

HIGH PRESSURE PAINT PUMP

CROSS REFERENCE TO RELATED APPLICATIONS

This application is a continuation application of U.S. application Ser. No. 14/482,223, filed Sep. 10, 2014, now U.S. Pat. No. 10,253,771, the disclosure of which is hereby incorporated by reference. Applicant claims priority under 35 U.S.C. sec. 120 of U.S. application Ser. No. 14/482,223.

FIELD OF THE INVENTION

The present invention relates generally to paint pumps adapted to pump liquid paint to such a high pressure that, upon release of the pressurized paint from a spray opening or nozzle in a spray gun, the paint is atomized and thereby rendered suitable for spray painting. More particularly, the present invention relates to an improved high pressure paint pump wherein the parts and components are so constructed and arranged as to provide maximum accessibility, ease of disassembly and mistake-proof reassembly of the parts of the pump.

BACKGROUND OF THE INVENTION

In hydraulic or airless paint spraying, a pump is utilized to pressurize the paint to pressures of 2,000 pounds per square inch and greater so that the paint can be atomized upon release from a nozzle in a spray gun. The type of pump preferably used for this purpose is the double acting piston pump because of the piston pump's ability to handle high viscosity paints or coatings easily and the capability of the double acting pump to pump fluid on both the upstroke and downstroke of the piston thereby providing a relatively even flow of paint to the nozzle of the spray gun. In the double acting piston pump a stepped piston reciprocates in a cylinder having an inlet at one end and an outlet at the second end whereby two chambers are formed in the cylinder by the stepped piston. The first or inlet chamber is defined by the piston head and the cylinder and the outlet or exhaust chamber is formed at the opposite end of the piston and is defined by the stepped down portion of the piston and the cylinder wall. A transfer or bypass valve is disposed in the piston to transfer paint from the inlet chamber to the outlet chamber. On the intake stroke of the piston the transfer valve is closed while simultaneously the inlet valve is opened by vacuum so as to draw paint into the inlet chamber. On the down or exhaust stroke of the piston, the inlet valve is closed by the fluid pressure exerted on it while the bypass valve is opened by the fluid pressure exerted on it so as to permit the paint in the inlet chamber to pass through the transfer valve and into the exhaust chamber. Because of the volume difference between the inlet and exhaust chambers, approximately half the paint transferred to the exhaust chamber is forced through the pump outlet during this stroke while the other half remains in the exhaust chamber. On the next intake stroke, as the piston withdraws in the cylinder it forces the remaining paint in the exhaust chamber through the pump outlet while at the same time paint is brought in through the inlet valve into the inlet chamber. An upper seal packing located at the upper extremity of the cylinder sealingly engages around the stepped down portion of the piston and seals the outlet chamber of the cylinder from the exterior. A lower seal packing located within the cylinder sealingly engages around the piston head and separates the outlet and inlet chambers.

Such hydraulic or airless high pressure paint pumps are used extensively in the painting industry for the painting of new constructions, industrial installations, etc. For the most part the only maintenance required for such pumps is the replacement of parts or components which are subject to wear. Such replacement of worn parts requires a rebuilding or refurbishing of the pump and generally involves the replacement of the packings or seals in the pumps which eventually leak as a result of wear and the replacement of the inlet and bypass valves which are also subject to wear and leakage. In order to accomplish this pump rebuilding or refurbishing, it is necessary to dismantle the pump section which includes removal of the pump piston so as to gain access to the seal packings and the inlet and bypass valves. The high pressure or airless paint sprayers or pumps currently available in the market are adapted to have their pump or fluid sections disengaged and removed from the driving components of the pump system so as to permit the dismantling thereof. However, because of the relatively complex nature of pump construction and arrangement of the parts therein, rebuilding of the pump and reassembly of the parts thereof requires special care and close attention and sometimes the use of special tools in order to insure a correct and proper rebuilding and reassembly, otherwise, damage or leakage in operation may result. Specifically, the packing seals used in such pumps generally consist of a plurality of sealing elements which may be formed into a unit wherein the sealing elements or sealing lips of the seal are oriented in one direction for effective sealing. The pump's upper packing has its sealing lips oriented downwardly while the lower packing has its sealing lips oriented or directed upwardly. If these seals are incorrectly oriented during assembly of the pump, improper sealing will result and leakage will occur. It is also critical during reassembly of the pump that the piston rod be properly centered and aligned for insertion into the pump cylinder otherwise again the seals may be damaged causing the pump to leak during operation. This piston insertion step is further exacerbated because a significant amount of force is required in order to overcome the resistance exerted by the seals during insertion of the piston rod into the cylinder so that the use of a hammer or mallet is frequently necessary to drive the piston rod into place. Thus, included with pump rebuilding kits provided by manufacturers are detailed instructions on the proper installation of the packing seals and assembly of the piston and cylinder and some manufacturers also include a guide tool to insure the proper alignment of the piston and cylinder during assembly. However, pumps rebuilt by painting contractors or their employees frequently leak in operation or are otherwise damaged because of the difficulty of such rebuilding or the inability or failure to follow rebuilding instructions carefully. An alternative available to painting contractors is to have the pumps rebuilt by the manufacturers thereof. The obvious drawbacks to this are the extended period of time that the pump is unavailable to the contractor and the expense therefor.

Another problem relating to the rebuilding of such pumps concerns the replacement of worn valves particularly the lower inlet valve. This valve is located in the well of the inlet valve housing at the pump inlet and the elements consist of a valve seat, a ball or flat valve, and a valve cage for limiting and guiding the movement of the ball or flat valve. A retainer is employed for retaining the valve elements in the valve housing. In rebuilding this portion of the pump the retainer must first be removed from the valve housing in order to gain access to the valve elements; next the valve cage is removed, then the ball or flat valve is removed and finally the valve seat is removed. However, after a period of use in pumping paint, a residual of paint accumulates in and around the valve elements and particularly the valve cage and after drying makes it difficult to remove the valve cage from the well of the housing. In such a case it is often necessary to utilize a tool, such as a screwdriver or pick, to pry the valve cage loose from the valve housing well so as to free the remaining valve elements for removal.

SUMMARY OF THE INVENTION

It is, therefore, a primary object of the present invention to provide a paint pump adapted to pressurize paint so that the paint can be atomized and sprayed onto a surface by means of a spray gun wherein the parts and components of the pump are so constructed and arranged as to provide maximum accessibility, ease of disassembly and mistake-proof reassembly of the pump.

The above object, as well as others which will hereinafter become apparent, is accomplished in accordance with the present invention by a high pressure, double acting piston paint pump which is an improvement over prior art pumps wherein the accessibility of the inlet valve elements is increased, the upper and lower packing seals located in the pump body can be installed in the proper orientation thereof without error, and the piston can be easily assembled with the pump cylinder and properly aligned therewith without the need for special tools or undue effort. The pump according to the present invention includes a piston guide/retainer wherein the inlet valve cage is formed integral therewith and the guide is inserted into the well of the inlet valve housing so as to retain the inlet valve seat and inlet ball valve at the bottom of the well at the inlet. Thus, upon removal of the piston guide/retainer from the inlet valve housing well, the valve cage is likewise removed whereby the ball valve and inlet valve seat are accessible and easily removed. In assembling the piston with the pump cylinder, the piston head is inserted into the piston guide/retainer disposed in the inlet valve housing thereby stabilizing the piston and serving to center and guide the piston during assembly with the pump cylinder. According to another aspect of the invention, both the upper and lower packing seals are designed to be positionable in the cylinder of the pump body so that the correct orientation of the sealing lips is easily attainable. According to yet another aspect of the invention, means are provided permitting co-operation between the inlet valve housing and the pump body or fluid housing during assembly of the piston rod with the pump cylinder whereby the piston is driven into the cylinder by a uniform and steady pressure which overcomes the resistance of the upper and lower seal packings.

BRIEF DESCRIPTION OF THE DRAWINGS

Other objects and features of the present invention will become apparent from the following detailed description considered in connection with the accompanying drawings. It is to be understood that the drawings are designed as an illustration only and not as a definition of the limits of the present invention.

In the drawings wherein similar reference characters denote similar elements throughout the several views.

DETAILED DESCRIPTION OF THE PREFERRED EMBODIMENT

Figure 1:
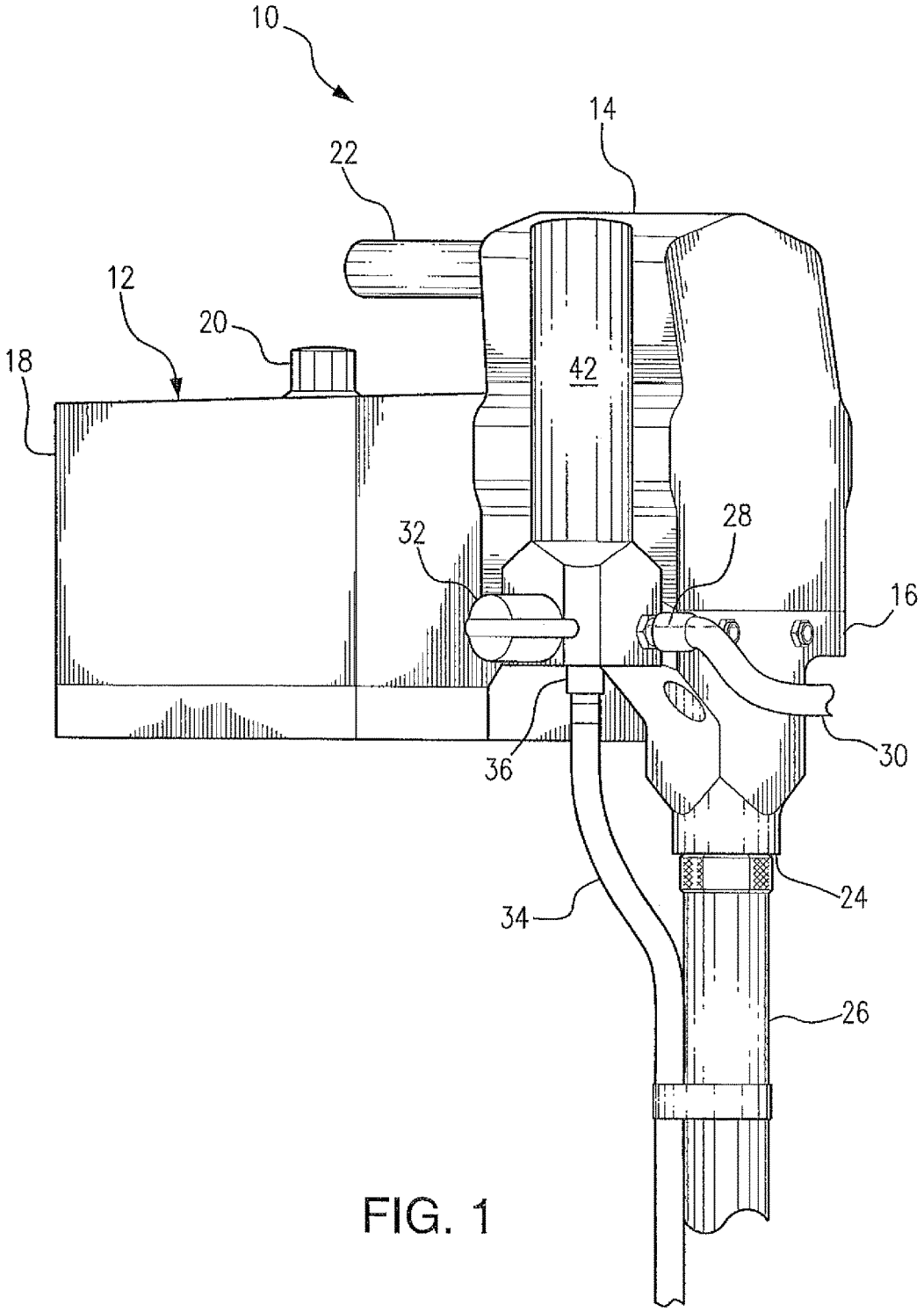
FIG. 1 is a perspective front elevational view of an airless paint sprayer or paint spray pump system incorporating the high pressure paint pump of the present invention.

Turning to the drawings, there is shown in FIG. 1 a high pressure paint spray pump system, generally designated 10, including a motor section 12, a gear box 14 and a pump section 16. Motor section 12 includes an electric motor whose drive shaft drives the pump of pump section 16 through a reduction gear and crank shaft housed in gear box 14. A motor controller, designated 18, controls the operation of the motor through an on/off switch (not shown) and a pressure control knob 20. A handle, designated 22, is provided at the top of gear box 14 to permit lifting and carrying of pump system 10. The inlet 24 of pump section 16 is connected by means of down tube 26 to a source (not shown) of paint such as a bucket or container of paint. The outlet 28 of pump section 16 communicates via a high pressure hose 30 with a spray gun (not shown) which atomizes the high pressure paint suitable for painting. A pressure relief valve located in pump section 16 is controlled by knob 32 and permits the dumping or releasing of pressurized paint contained in the pump section upon shut down which is returned to the paint source via tube 34 connected to relief valve outlet 36. Pump system 10 may be mounted on a wheeled cart (not shown) for ease of movement or on support legs (not shown).

Figure 2:
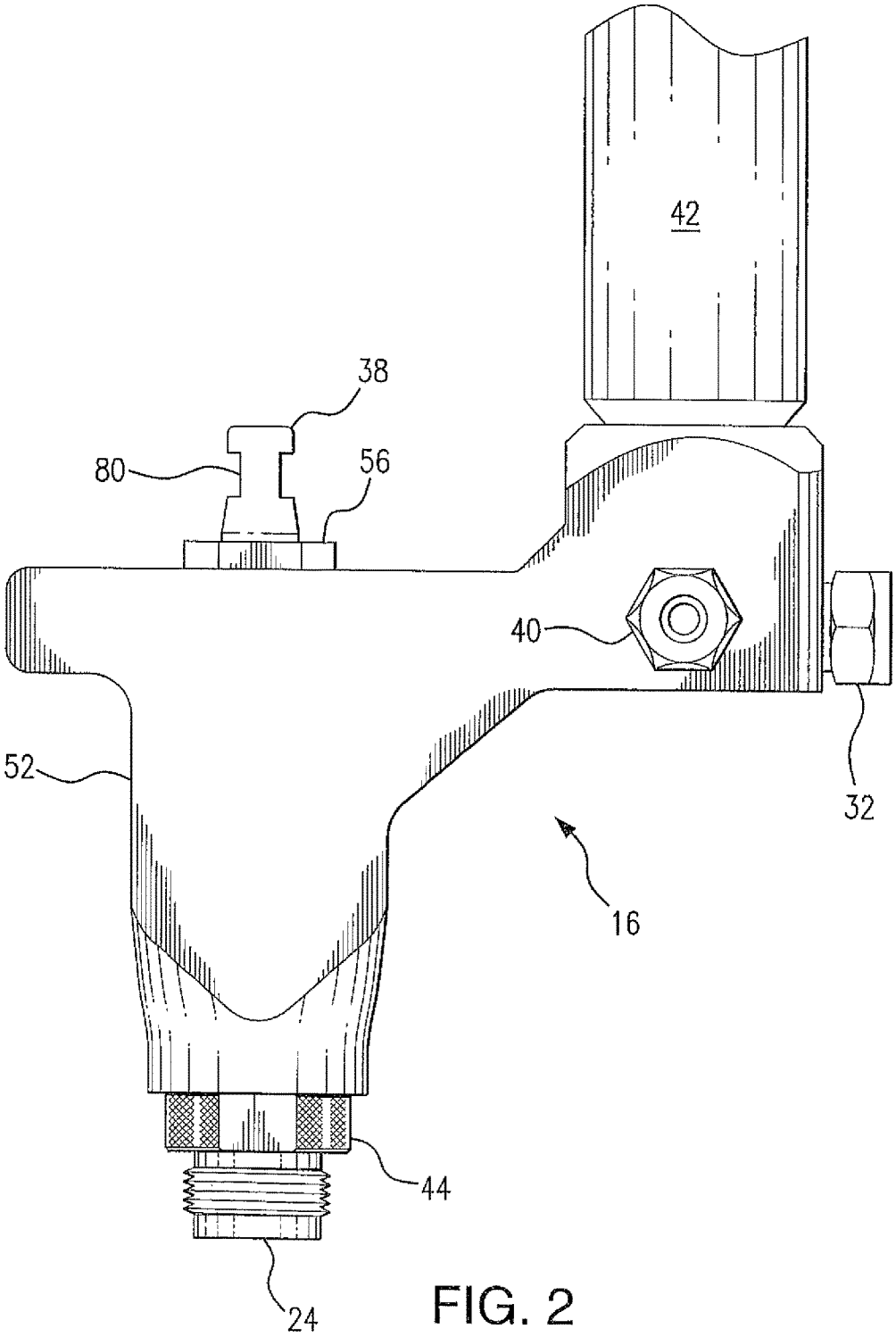
FIG. 2 is a rear elevational view of the high pressure pump as utilized in the pump system of FIG. 1.

FIG. 2 shows pump section 16 disconnected from pump system 10 which is accomplished by removing the connecting bolts (not shown) which secure pump section 16 to gear box 14 and disconnecting the slotted piston rod 38 from the crank shaft connecting rod located in the gear box. A pressure sensor (not shown) is connected to pump section 16 at fitting 40 located near outlet 28 of the pump section in order to measure the pressure of the paint leaving the pump section. This pressure sensor is in operative communication with the pressure control elements of controller 18. A filter (not shown) is housed in removable filter housing 42 adjacent to pump outlet 28 so as to filter the pressurized paint as it leaves pump section 16.

Figure 3:
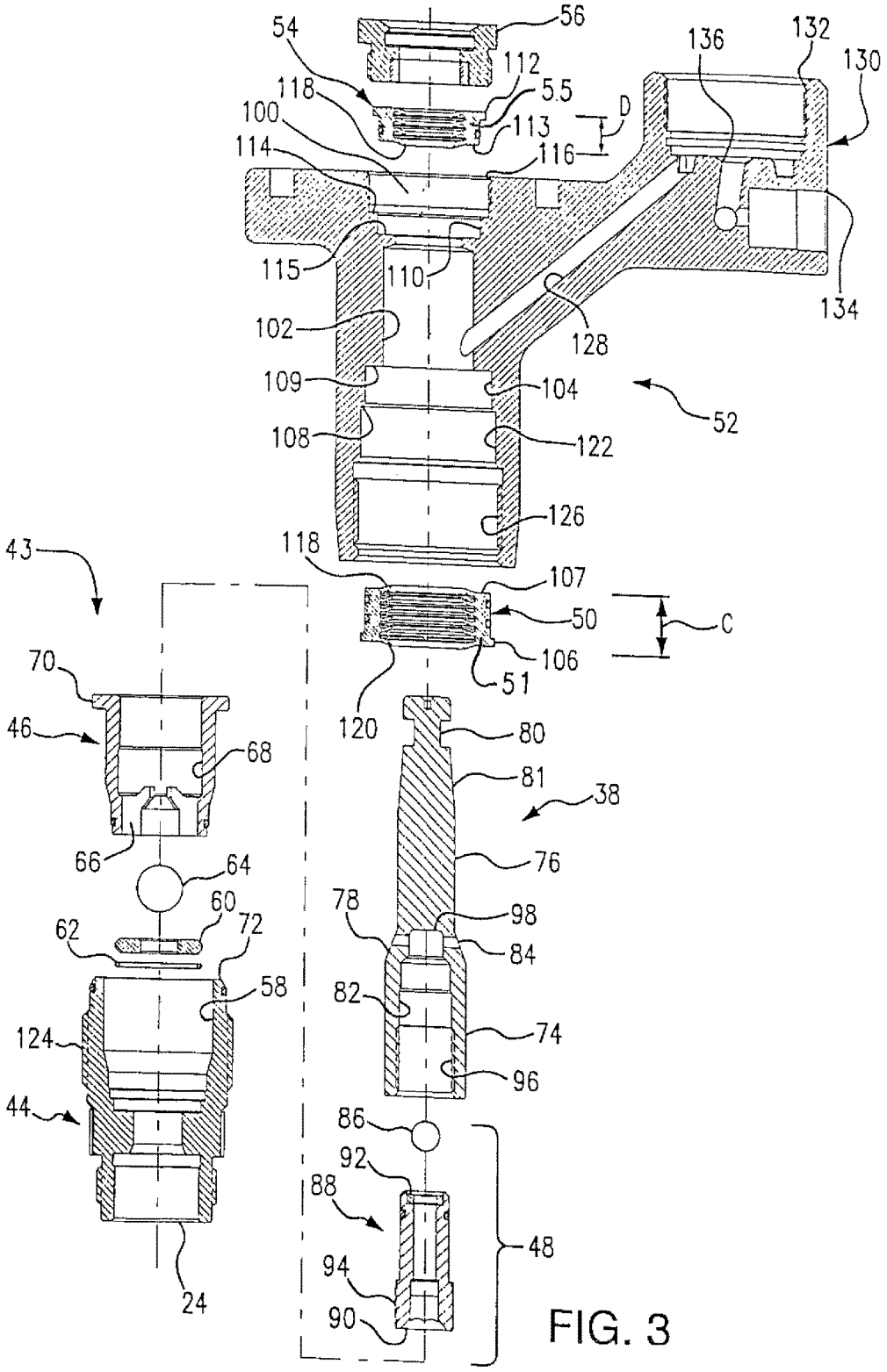
FIG. 3 is a cross-sectional exploded view of the high pressure pump of FIG. 2.

FIG. 3 is an exploded view of pump section 16 which basically comprises an inlet valve assembly 43 including an inlet valve housing 44 and a combination piston guide and inlet valve retainer 46, a transfer valve assembly 48, a piston rod 38, a lower seal packing 50, a pump or fluid body 52, an upper seal packing 54, and an upper seal retainer and piston guide 56. Inlet valve housing 44 is provided with a deep-set well 58 at its end opposite pump inlet 24 adapted to accept therein inlet valve seat 60, "O" ring seal 62, ball valve 64, and piston guide and inlet valve retainer 46. Piston guide and inlet valve retainer 46, fits snugly in well 58 and includes an inlet valve cage 66 integrally formed at the bottom of the guide for containing and limiting the movement of ball valve 64 to permit fluid to pass thereby and retain valve seat 60 and "O" ring seal 62 at the bottom of well 58 at the pump inlet 24. A central bore 68 in piston guide and inlet valve retainer 46 is sized to accept therein with sliding clearance the lower end or head of piston 38 and serves as the lower part of the pump cylinder. A laterally extending rim or lip 70 is provided at the upper end of piston guide and inlet valve retainer 46 and permits the easy removal of the piston guide and inlet valve retainer from the well 58 of housing 44 with the aid of a screwdriver blade inserted in the small groove or channel 71 (see FIGS. 4 and 5) provided between rim 70 and the upper end 72 of housing 44. Piston rod 38 is stepped to provide a large diameter lower piston section or piston head 74 and a relatively smaller diameter upper piston section or piston base 76. Piston transition section 78 connecting lower piston section 74 to the upper piston section 76 is gradually tapered. The upper extremity of piston rod 38 is provided with slots 80 in order to facilitate connection with the connecting rod in gear box 14. Between piston section 76 and slots 80, piston rod 38 is provided with a gradually tapered piston section 81. The reasons for the tapering of piston sections 78 and 81 are explained below. Extending centrally through lower piston section or piston head 74 is a bore 82 which terminates at a cross-bore or piston outlet 84 located at transition section 78. Transfer valve assembly 48 includes ball valve 86 and valve seat/retainer 88 wherein a through bore 90 in retainer 88 terminates at an integral valve seat 92. Valve seat/retainer 88 has external threads 94 engageable with internal threads 96 in bore 82 of piston 38 so that upon combining transfer valve assembly 48 with piston 38 the transfer or by-pass valve is established in valve chamber 98 communicating with piston outlet 84.

Pump body 52 is provided with a through bore 100 segmented along its length to accept the various component parts of the pump. Specifically, central bore segment 102 serves as the upper part of the pump cylinder and is sized to slidingly receive piston head 74 of piston 38. Bore segment 104 is adapted to receive therein lower seal packing 50 which is provided at its lower end with an outwardly extending rim 106 adapted to seat on shelf 108 in bore 100 while the upper end 107 of seal packing 50 is adapted to seat on shelf 109 in bore 100. Bore segment 110 is adapted to receive therein upper seal packing 54 which is provided at its upper end with an outwardly extending rim 112 adapted to seat on shelf 114 in bore 100 while the lower end 113 of seal packing 54 is adapted to seat on shelf 115 in bore 100. Bore segment 116 at the upper extremity of bore 100, is internally threaded and sized to accept threaded upper seal retainer and piston guide 56 which abuts against rim 112 of seal packing 54 to secure the packing in position between shelves 114 and 115. Stepped piston 38 is inserted in bore 100 to extend through seal packings 50 and 54 and extend beyond upper seal retainer and piston guide 56 so that its upper end with slot 80 protrudes from pump body 52 as shown in FIG. 2. Lower seal packing 50 seals against lower piston section 74 and upper seal packing 54 seals against upper piston section 76 and delineate between them central bore segment 102 of through bore 100 which together with upper piston section 76 constitutes the pump outlet chamber, designated 140 and described in connection with FIGS. 4~5 hereinafter. Lower and upper seal packings 50 and 54 are comprised of seal packing bodies, designated 51 and 55 respectively, having formed along an inner surface or hub a plurality of substantially radially, inwardly directed annular flexible sealing lips or wipers, designated 118, which are substantially parallel to and spatially separated from each other in the axial direction. Each of the ends of sealing lips 118 is bent or slanted in the axial direction towards the area of high pressure in outlet chamber 140 except for the bottom most sealing lip 120 of lower seal packing 50 whose sealing end is oppositely directed, the reason for which is explained below. Bore segment 122, at the lower extremity of bore 100, is adapted to receive inlet valve assembly 43 including inlet valve housing 44 assembled with piston guide and inlet valve retainer 46 and the inlet valve. Inlet valve housing 44 is provided with external threads 124 which engage with internal threads 126 in bore segment 122 so that when valve housing 44 is screwed into bore segment 122, rim 70 of piston guide and inlet valve retainer 46 abuts against rim 106 of lower seal packing 50 to secure the packing in position between shelves 108 and 109. An outlet bore 128 is provided in pump section 16 intersecting with central bore segment 102 and extending to the outlet section 130 of pump body 52. Outlet section 130 includes a well 132 for receiving the pump filter and threaded filter housing 42. Well 132 also communicates with pump outlet 28 and pressure relief valve chamber 134 via bore 136.

Figure 4:
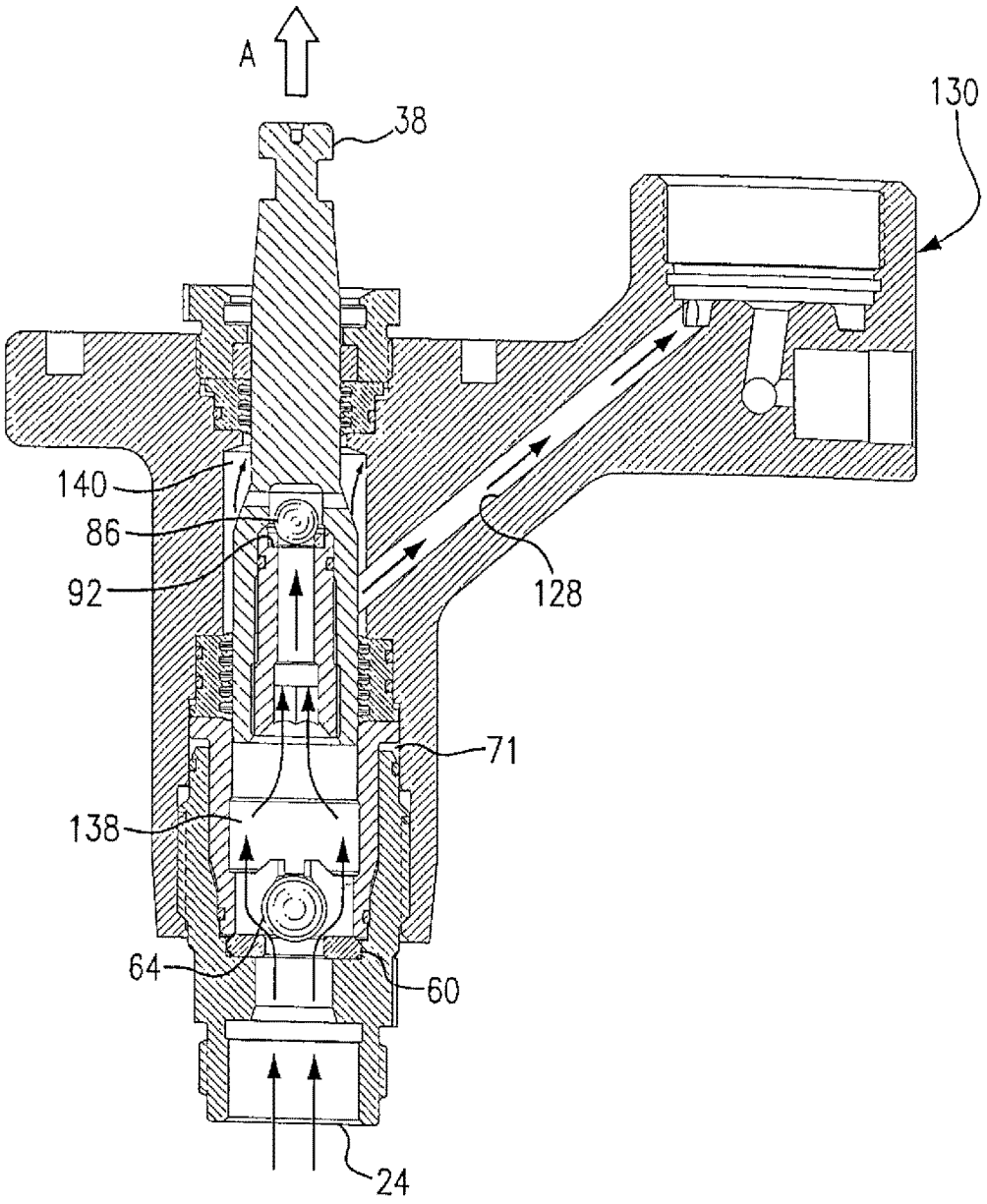
FIG. 4 is a cross-sectional view of the high pressure pump of the present invention showing the pumping action of the pump on the upstroke of the piston.
Figure 5:
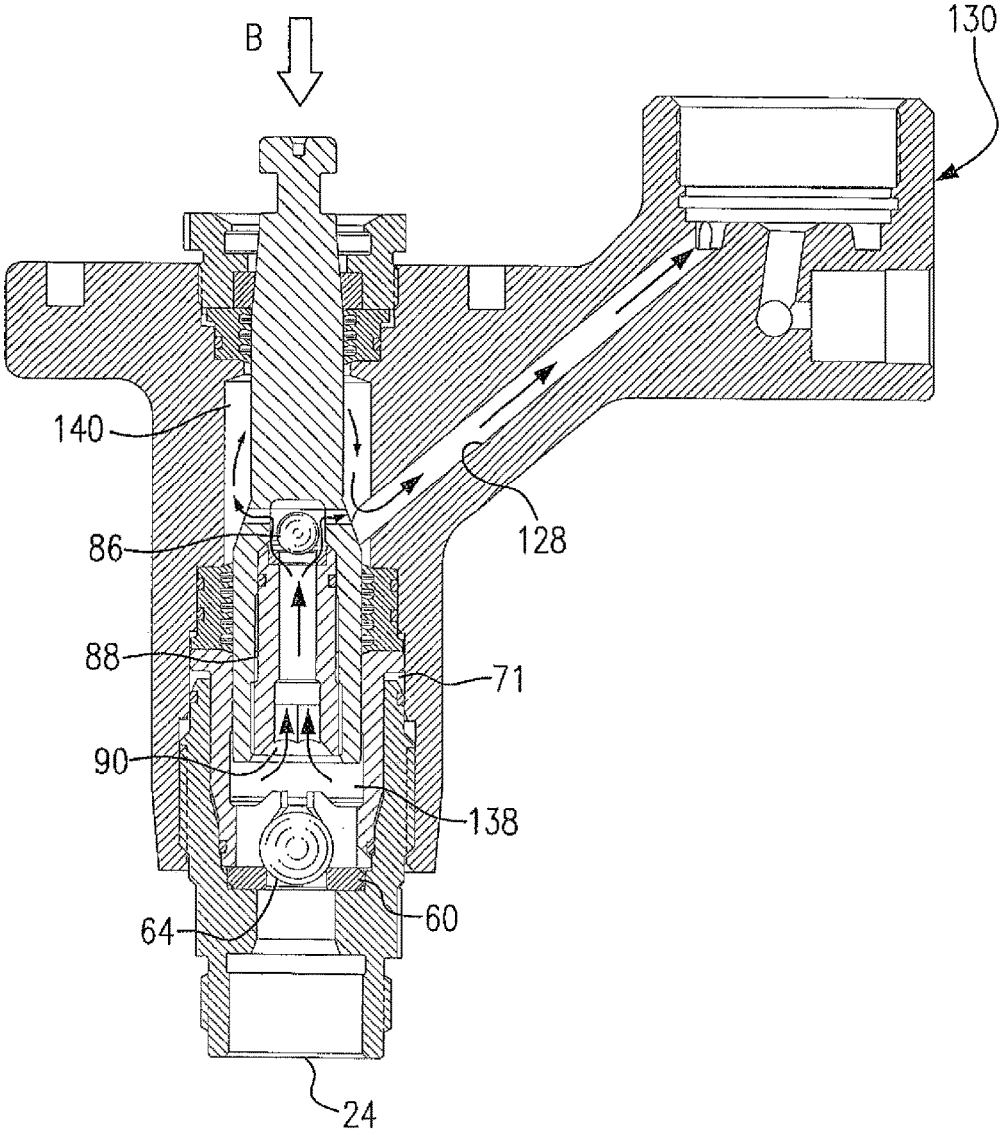
FIG. 5 is a cross-sectional view of the pump similar to that of FIG. 4 showing the pumping action of the pump on the downstroke of the piston.

FIGS. 4 and 5 show the pumping operation of the pump according to the present invention. The upstroke of piston rod 38 in the direction "A" is shown in FIG. 4 where ball 64 of the inlet valve is lifted off its seat 60 by the suction created by the rising piston which suction causes liquid paint to be drawn into inlet chamber 138 through pump inlet 24. Simultaneously, the liquid paint contained in outlet chamber 140 is discharged under pressure by the piston through outlet bore 128 to outlet section 130 where it passes through the filter and exits pump section 16 via pump outlet 28. As piston 38 is withdrawn in inlet chamber 138, ball 86 of the transfer valve in piston 38 is forced onto its seat 92 thereby preventing any liquid paint from being transferred to outlet chamber 140 through cross-bore or outlet 84 in piston 38. The downstroke of piston rod 38 in the direction "B" is shown in FIG. 5 where the ball 64 of the inlet valve is forced onto its seat 60 by the downward pressure exerted on it by the pressurized liquid paint in inlet chamber 138 thereby preventing paint from exiting inlet chamber 138 through pump inlet 24. Simultaneously, ball 86 of the transfer valve in piston 38 is lifted off its seat 92 by the pressure of the fluid paint being discharged from inlet chamber 138 and through bore 90 in valve seat/retainer 88. After passing ball 86 of the transfer valve, the fluid paint passes through piston outlet 84 and into outlet chamber 140. Because of the greater volume of fluid paint being pumped from inlet chamber 138 to outlet chamber 140, the excess in outlet chamber 140 is discharged through outlet bore 128 to outlet section 130, through the pump filter and finally to the pump outlet 28.

As clearly seen in FIGS. 4 and 5, lower seal packing 50 tightly seals against piston head section 74 while upper seal packing 54 tightly seals against piston base 76 thereby effectively sealing outlet chamber 140 from the exterior and from inlet chamber 138 during the upstroke and downstroke of piston 38. The bottom sealing lip 120 of lower seal packing 50, has its sealing end directed toward inlet chamber 138, which prevents any particles or debris in inlet chamber 138 from passing lip 120 and being entrapped by sealing lips 118 of seal packing 50 and scoring piston head 74 during the up and down movement of piston rod 38.

Figure 6:
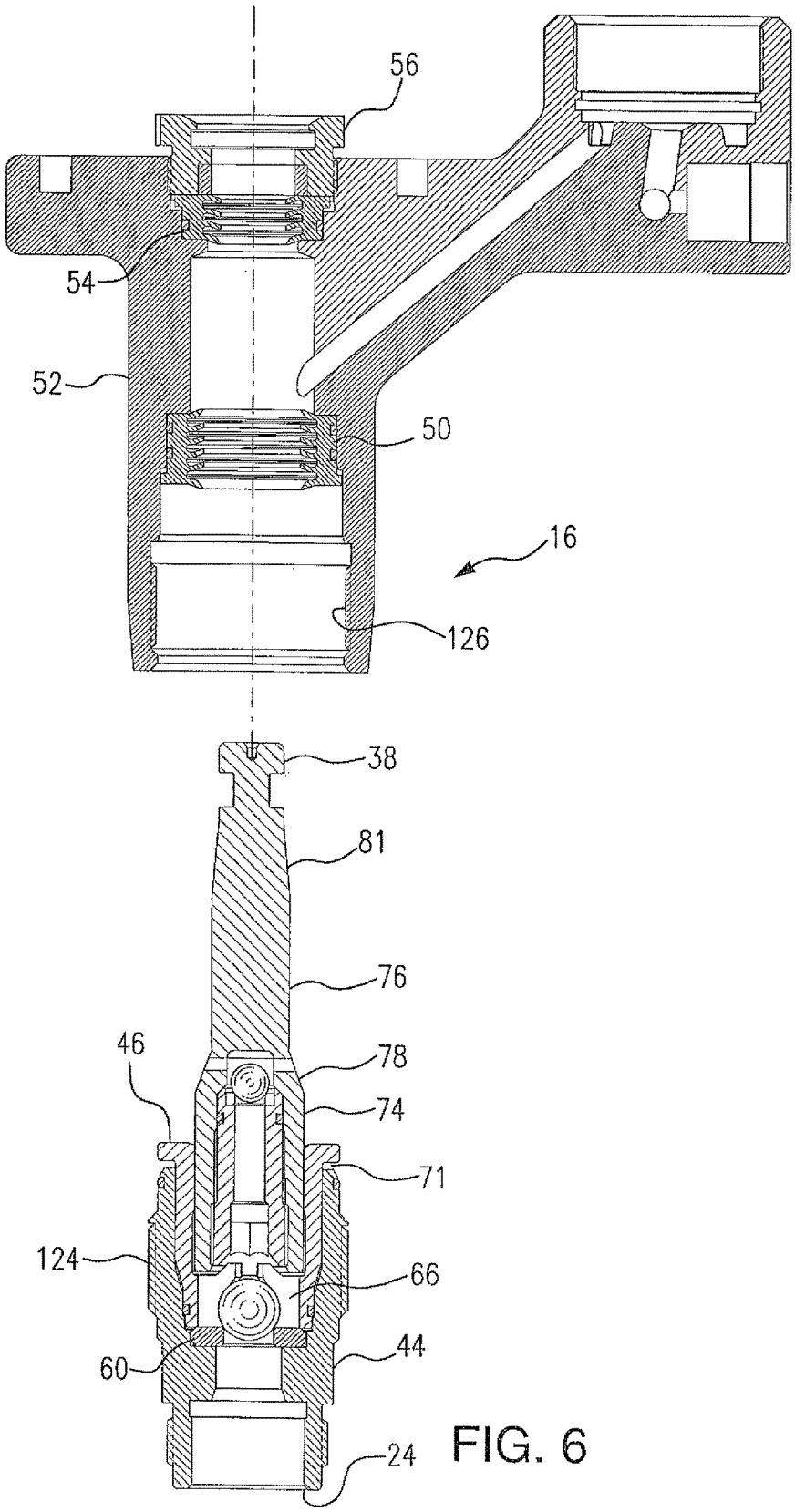
FIG. 6 is a cross-sectional view of the high pressure pump of the present invention showing the first step in the assembly thereof.
Figure 7:
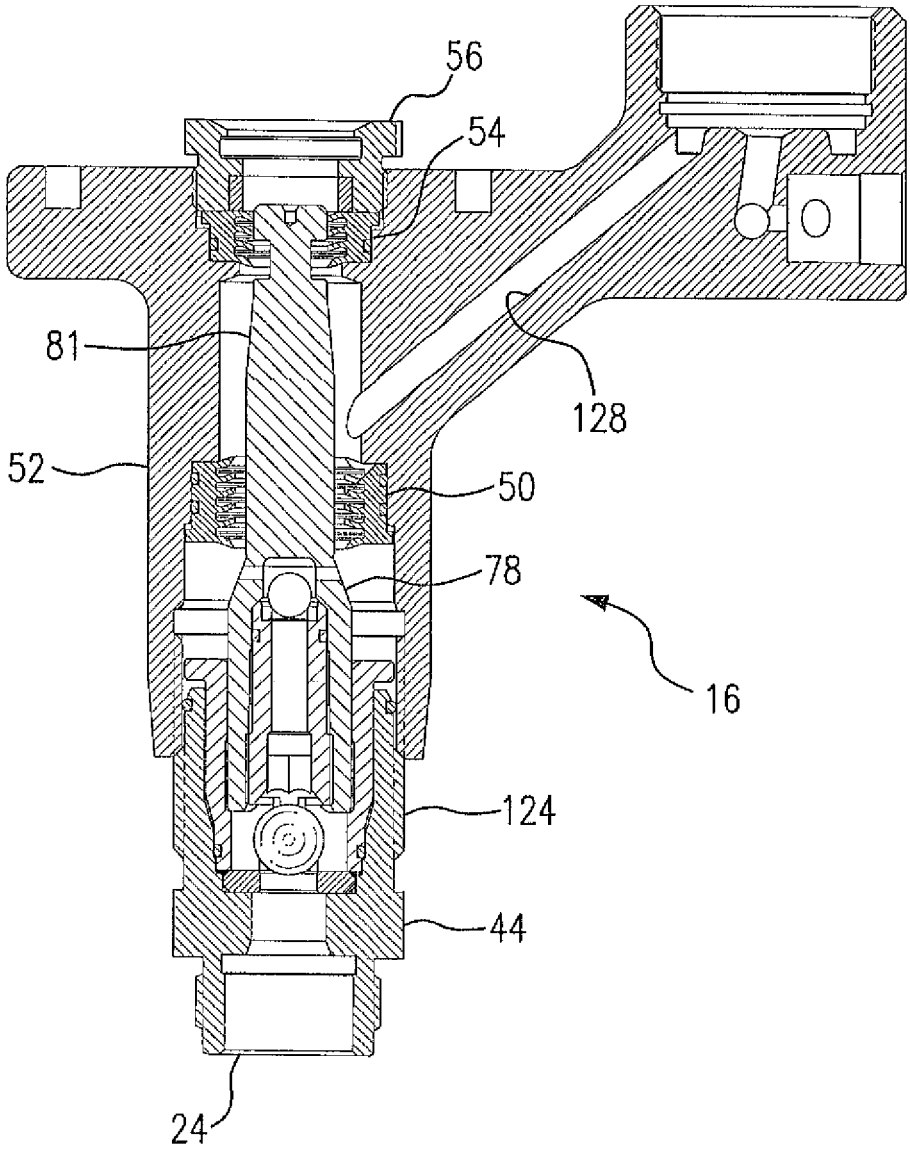
FIG. 7 is a cross-sectional view of the high pressure pump similar to that of FIG. 6 showing the second step in the assembly thereof.
Figure 8:
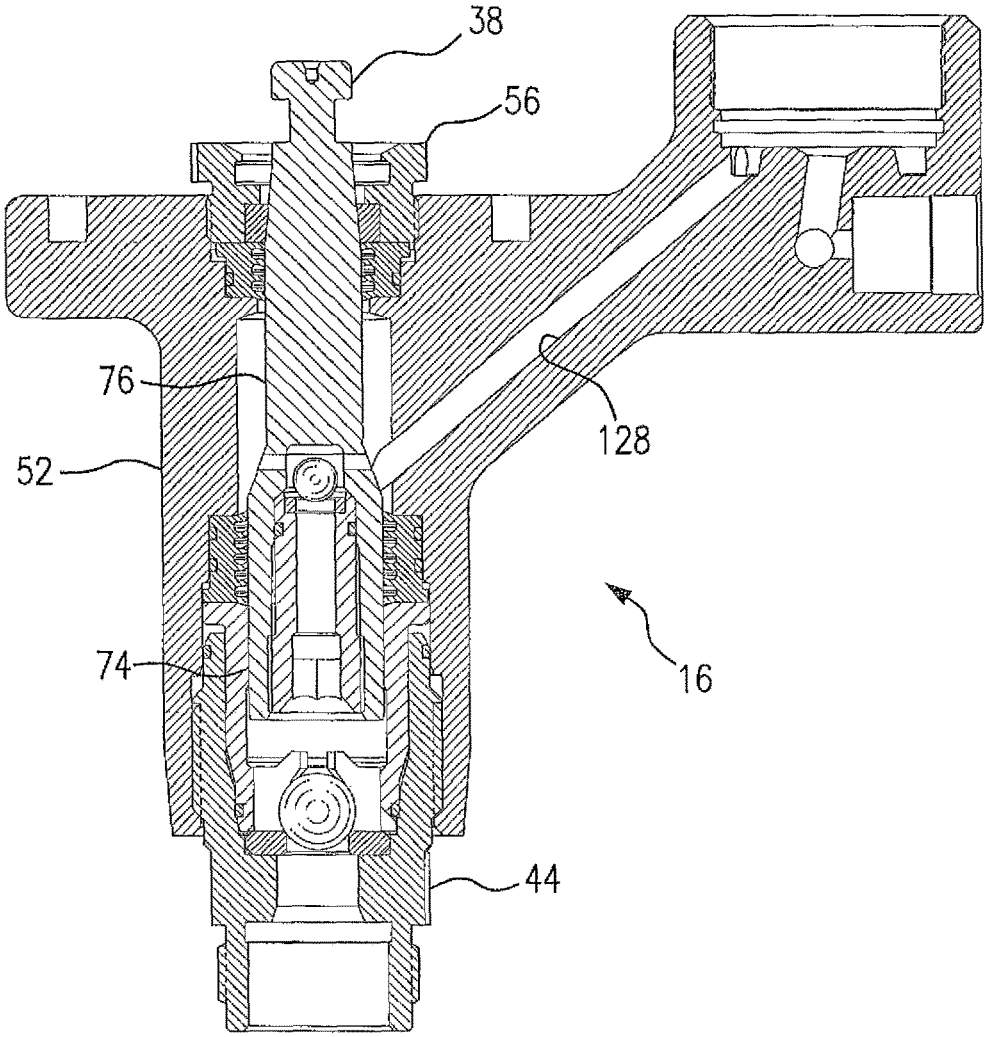
FIG. 8 is a cross sectional view of the high pressure pump similar to that of FIGS. 6 and 7 showing the final assembly thereof.

FIGS. 6, 7 and 8 depict the assembly of pump section 16 after replacement of the worn parts thereof. Initially, lower seal packing 50 and upper seal packing 54 are inserted into bore 100 so that the sealing lips 118 thereof have their sealing ends directed inwardly towards bore segment 102 of bore 100. The respective rims 106 and 112 of the lower and upper seal packings come to rest on the respective shelves 108 and 114 in bore 100 so as to properly position and orient the seal packings within bore 100 of pump body 52. It should be pointed out that in the event the seal packings are mistakenly inserted so as to be inverted with respect to their proper orientation, the respective rims 106 and 112 of the lower and upper seal packings will still come to rest on the respective shelves 108 and 114 in bore 100 so that the respective bodies 51 and 55 of the seal packings, having axial dimensions "C" and "D" respectively, project in directions opposite to the intended directions. Because of the axial dimensions "C" and "D" of seal packings 50 and 54, the respective bodies 51 and 55 of the incorrectly installed lower and upper seal packings form obstructions which effectively prevent the complete assembly of upper seal retainer and piston guide 56 and inlet valve housing 44 with pump body 52. As a result, the improper installation of the upper and lower seal packings 54 and 50 is clearly and easily ascertainable and can thus be rectified. As clearly seen in FIG. 6, the lower piston section or piston head 74 is inserted into bore 68 of piston guide and inlet valve retainer 46 which has previously been assembled together with inlet valve housing 44. Piston 38 is then aligned with bore 100 of pump body 52 in anticipation of being inserted therein.

The next step in assembling pump section 16 is shown in FIG. 7 where it can be seen that piston 38 has been inserted into bore 100 of pump body 52 to the extent that tapered sections 78 and 81 are on the verge of engaging with lower seal packing 50 and upper seal packing 54, respectively. At this point in the assembly of the pump section, the threads 124 of valve housing 44 commence their engagement with threads 126 in bore segment 122 of bore 100 of pump body 52. The continued screwing or rotation of inlet valve housing 44 relative to pump body 52 drives housing 44 together with piston guide and inlet valve retainer 46 and piston 38 further into bore 100 without excessive effort or force because of the mechanical advantage of the screw. The purpose for the tapered sections 78 and 81 of piston 38 is to allow the gradual deformation of flexible sealing lips 118 of seal packings 50 and 54 and the oppositely directed sealing lip 120 of packing 50. Because of this gradual deformation or widening of the sealing lips 118 and 120 by the gradual upward movement of the tapered sections of the piston 38, the flexible sealing lips are prevented from being upset or directionally inverted. During this insertion step, as inlet valve housing 44 is threaded into pump body 52, piston guide and inlet valve retainer 46 maintains piston rod 38 in alignment with the axis of bore 100 whereby any possible damage to packing seals 50 and 54 is avoided.

FIG. 8 shows the assembled pump section 16 following completion of the piston insertion step. As clearly seen, intake valve housing 44 is fully threaded into bore segment 122 of bore 100 of pump body 52 so that lower seal packing 50 sealingly engages with lower piston section 74 and upper seal packing 54 sealingly engages with upper piston section 76. With intake valve housing 44 fully threaded into pump body 52, the upper extremity of piston rod 38 extends from bore 100 and above upper seal retainer and piston guide 56 so that it may be grasped to allow attachment of piston 38 to the connecting rod in gear box 14.

While only a single embodiment of the present invention has been shown and described, it will be obvious that many changes and modifications may be made thereto without departing from the spirit and scope of the invention.

What is claimed is:

1. A method of assembling a double acting piston pump for use in an airless paint spray pump adapted for pumping and pressurizing fluid paint to be sprayed to a pressure sufficient for hydraulic atomization thereof by a spray gun, wherein said pump includes a pump body having a through bore therein defining a pump cylinder, a stepped piston having larger and smaller diameter piston sections reciprocal in said pump cylinder according to a downstroke and an upstroke of said piston, said larger diameter piston section and pump cylinder defining an inlet chamber communicating with a pump inlet, said smaller diameter piston section and pump cylinder defining an outlet chamber communicating with a pump outlet, said inlet chamber having a greater volume than said outlet chamber defining a differential volume therebetween, said stepped piston includes a first gradually tapered piston section preceding the smaller diameter piston section tapering toward an upper end of said stepped piston, a first seal packing arranged in said through bore to sealingly engage about said smaller diameter piston section and having formed along an inner surface a plurality of substantially radially inwardly directed annular flexible sealing lips substantially parallel to and spatially separated from each other in the axial direction having ends slanted axially towards said outlet chamber, a second seal packing arranged in said through bore to sealingly engage about said larger diameter piston section and separating said inlet and outlet chambers and together with said first seal packing delineating therebetween said outlet chamber, a transfer valve for allowing paint to be transferred from said inlet chamber to said outlet chamber on the downstroke of said piston, an inlet valve assembly positionally arranged in said through bore in communication with said inlet chamber for allowing paint to be transferred through said pump inlet from a paint source to said inlet chamber on the upstroke of said piston, said inlet valve assembly incorporating at a first end said pump inlet and an inlet valve and having a central bore adapted to receive therein at a second end of said inlet valve assembly with sliding clearance and reciprocal movement said larger diameter piston section and forming a lower part of said pump cylinder, said inlet valve assembly having external screw threads adapted for engagement with complimentary screw threads internally of said pump body through bore so as to operatively position said inlet valve assembly within said through bore, wherein the relative axial arrangement and dimensions of said pump cylinder, stepped piston, first seal packing, inlet valve assembly external screw threads and pump body through bore internal screw threads are such that, with the larger diameter piston section received in the central bore of said inlet valve assembly in preparation for assembling said double acting piston pump, the first gradually tapered piston section does not engage the sealing lips of said first seal packing until the inlet valve assembly external screw threads commence engagement with the pump body through bore internal screw threads, and upon the completion of screwing and the final operative positioning of said inlet valve assembly in said pump body through bore the first seal packing sealingly engages about the smaller diameter piston section, said method of pump assembly comprising the steps of:

a) positioning the larger diameter piston section in the central bore of said inlet valve assembly so that said stepped piston is stabilized with and maintained in axial alignment with said inlet valve assembly;

b) aligning and centering said combined stepped piston and inlet valve assembly with the pump body through bore for insertion therein;

c) engaging the inlet valve assembly external screw threads with the pump body through bore internal screw threads; and d) gradually screwing said inlet valve assembly into said pump body through bore whereby resistance to the insertion of the stepped piston into the pump body through bore by the first and second seal packings is overcome by the mechanical advantage produced by the screw threads of the inlet valve assembly and the pump body through bore and further so that the first gradually tapered piston section of said stepped piston gradually radially widens the flexible sealing lips of said first seal packing without directionally inverting or upsetting the ends of the sealing lips of said first seal packing until said inlet valve assembly is fully screwed into and inserted within said pump body through bore and said first seal packing sealingly engages about the smaller diameter piston section of said stepped piston.

2. The method for assembling a double acting piston pump as defined in claim 1, wherein said second seal packing having a seal element disposed axially most distant from said outlet chamber with a substantially radially inwardly directed annular flexible sealing lip having an end slanted axially towards said inlet chamber, and said stepped piston further includes a second gradually tapered piston section between the smaller and larger diameter piston sections, wherein the relative axial arrangement and dimensions of said pump cylinder, stepped piston, second seal packing, inlet valve assembly external screw threads and pump body through bore internal screw threads are such that, with the larger diameter piston section received in the central bore of said inlet valve assembly, the second gradually tapered piston section does not engage the sealing lip of said second seal packing until the inlet valve assembly external screw threads commence engagement with the pump body through bore internal screw threads, and upon the completion of screwing and the final positioning of said inlet valve assembly in said pump body through bore the second seal packing sealingly engages about the larger diameter piston section, so that during the step of gradually screwing said inlet valve assembly into said pump body through bore the second gradually tapered piston section gradually radially widens the sealing lip of the second seal packing disposed axially most distant from the outlet chamber without directionally inverting or upsetting the end of said sealing lip of said second seal packing until said inlet valve assembly is fully screwed into and inserted within said pump body through bore and said second seal packing engages about the larger diameter piston section of said stepped piston.

* * * * *